US007586468B2

(12) United States Patent
Sano

(10) Patent No.: US 7,586,468 B2
(45) Date of Patent: Sep. 8, 2009

(54) DISPLAY DEVICE USING CURRENT DRIVING PIXELS

(75) Inventor: Keiichi Sano, Taipei (TW)

(73) Assignee: Sanyo Electric Co., Ltd. (JP)

( * ) Notice: Subject to any disclaimer, the term of this patent is extended or adjusted under 35 U.S.C. 154(b) by 733 days.

(21) Appl. No.: 10/872,347

(22) Filed: Jun. 18, 2004

(65) Prior Publication Data

US 2005/0024352 A1 Feb. 3, 2005

(30) Foreign Application Priority Data

Jun. 20, 2003 (JP) ..... 2003-177262
Jun. 20, 2003 (JP) ..... 2003-177264

(51) Int. Cl.
*G09G 5/00* (2006.01)

(52) U.S. Cl. ..... 345/76; 345/55; 345/82

(58) Field of Classification Search ..... 345/204, 345/76–80, 55; 2/204
See application file for complete search history.

(56) References Cited

U.S. PATENT DOCUMENTS 6,130,568 A * 10/2000 Kwon et al. ..... 327/307
6,501,466 B1 12/2002 Yamagishi et al.
6,858,991 B2 2/2005 Miyazawa
6,961,054 B2 * 11/2005 Matsumoto ..... 345/204
7,015,884 B2 * 3/2006 Kwon ..... 345/78
7,102,600 B2 * 9/2006 Kasai ..... 345/77
7,109,953 B2 * 9/2006 Abe et al. ..... 345/76
7,205,967 B2 * 4/2007 Morishige et al. ..... 345/77
2003/0030602 A1 * 2/2003 Kasai ..... 345/76
2004/0046164 A1 * 3/2004 Kobayashi et al. ..... 257/13
2004/0239668 A1 * 12/2004 Morosawa et al. ..... 345/212
2005/0017929 A1 * 1/2005 Sano et al. ..... 345/76

FOREIGN PATENT DOCUMENTS

JP 2001-147659 5/2001

OTHER PUBLICATIONS

"The impact of the Transient Response of Organic light Emitting Diodes on the Design of Active Matrix OLED Displays" RMA Dawson, IEEE, 1998.*
Reiji Hattori et al.; "Current-Writing Active-Matrix Circuit for Organic Light-Emitting Diode Display Using a-Si:H Thin-Film-Transistors"; IEICE Trans. Electron., vol. E83-C, No. 5, May 2000, pp. 779-782.
Office Action mailed May 12, 2006 for corresponding KR appln. No. 10-2004-48505 with complete English translation. KR Patent Laid-Open Publication No. 2002-56353, dated Jul. 10, 2002, with its English Abstract.
KR Patent Laid-Open Publication No. 2003-22693, dated Mar. 17, 2003, with its English Abstract.

* cited by examiner

*Primary Examiner*—Sumati Lefkowitz
*Assistant Examiner*—Grant D Sitta
(74) *Attorney, Agent, or Firm*—Cantor Colburn LLP

(57) ABSTRACT

A video signal line receives a voltage video signal. The supplied voltage video signal is provided to a voltage-current conversion circuit in a corresponding column. The voltage-current conversion circuit converts the voltage video signal into a current signal, and supplies the current signal to a corresponding pixel circuit. Each voltage-current conversion circuit includes an output transistor for supplying current in accordance with the voltage video signal, and a compensation circuit for compensating for variations in threshold of the output transistor.

6 Claims, 13 Drawing Sheets

DISPLAY DEVICE USING CURRENT DRIVING PIXELS

CROSS-REFERENCE TO RELATED APPLICATIONS

The priority applications Numbers 2003-177262 and 2003-177264 upon which this patent application is based are hereby incorporated by reference.

BACKGROUND OF THE INVENTION

1. Field of the Invention

The present invention relates to a display device for presenting a display by supplying a current video signal converted from a voltage video signal to a pixel circuit.

2. Description of the Related Art

Electroluminescence (hereinafter referred to as "EL") display devices using a self-emissive EL element as an emissive element for each pixel offer advantages of, for example, self-emissive properties and reduced power consumption, and are therefore attracting attention for their potential to replace liquid crystal display devices (LCDs) and CRTs.

Active matrix type EL display devices wherein a switch element, such as a thin film transistor (TFT) for individually controlling EL elements, is provided for each pixel and the EL element is controlled for each pixel, can achieve especially high resolution displays.

In such an active matrix EL display device, generally, on a substrate, a plurality of gate lines extend in a row direction, a plurality of data lines and power source lines extend in a column direction, and each pixel is provided with an organic EL element, a selection TFT, a driving TFT, and a storage capacitor. By selecting the gate line, the selection TFT is turned on, a data voltage on the data line (voltage video signal) is charged in the storage capacitor, and this voltage turns on the driving TFT, thereby supplying power from the power source line to the organic EL element.

Japanese Patent Publication JP-A-2001-147659, (hereinafter referred to as "Document 1") discloses a circuit in which two additional p-channel TFTs are provided for each pixel as controlling transistors and data current (current video signal) in accordance with display data is supplied to the data line.

In other words, Document 1 discloses a circuit in which the current video signal is supplied to the data line and to a current voltage conversion TFT to set a gate voltage of the driving TFT.

The circuit disclosed in Document 1 can set the gate voltage of the driving TFT in accordance with the data current flowing through the data line, so that the driving current of the EL element can be more accurately controlled compared with circuits wherein a voltage signal is supplied to the data line. Further, the number of elements can be relatively decreased by sharing the current voltage conversion TFTs.

In the configuration disclosed in Document 1, however, the data current must be supplied to the data line in order to drive each pixel circuit. Because video signals are ordinarily voltage signals, circuits, such as voltage-current conversion circuits for converting a voltage signal into a current signal, are required, and an IC (semiconductor integrate circuit) including the voltage-current conversion circuit must be additionally provided to supply the current signal to the display device from the IC.

Providing an additional IC including the voltage-current conversion circuit requires that the IC be separately prepared, entailing development and production costs, and therefore increasing the cost of the display device.

Although the voltage-current conversion circuit may be included in the display device to utilize the voltage-current conversion circuit used in the pixel of conventional active matrix EL display devices, improvement is required to overcome nonuniformity caused by variation in TFTs.

SUMMARY OF THE INVENTION

A display device of the present invention includes a voltage-current conversion circuit for converting a voltage video signal into a current video signal. The voltage-current conversion circuit includes an output transistor for receiving the voltage video signal at its gate and supplying a corresponding drain current, and a compensation circuit for compensating for variation in threshold voltage of the output transistor.

Provision of the compensation circuit in this manner enables the elimination of inaccurate output current signals, even when the threshold voltage of the current conversion circuit is different from a predetermined voltage.

DESCRIPTION OF PREFERRED EMBODIMENTS

Embodiments of the present invention will next be described with reference to the accompanying drawings.

Figure 1:
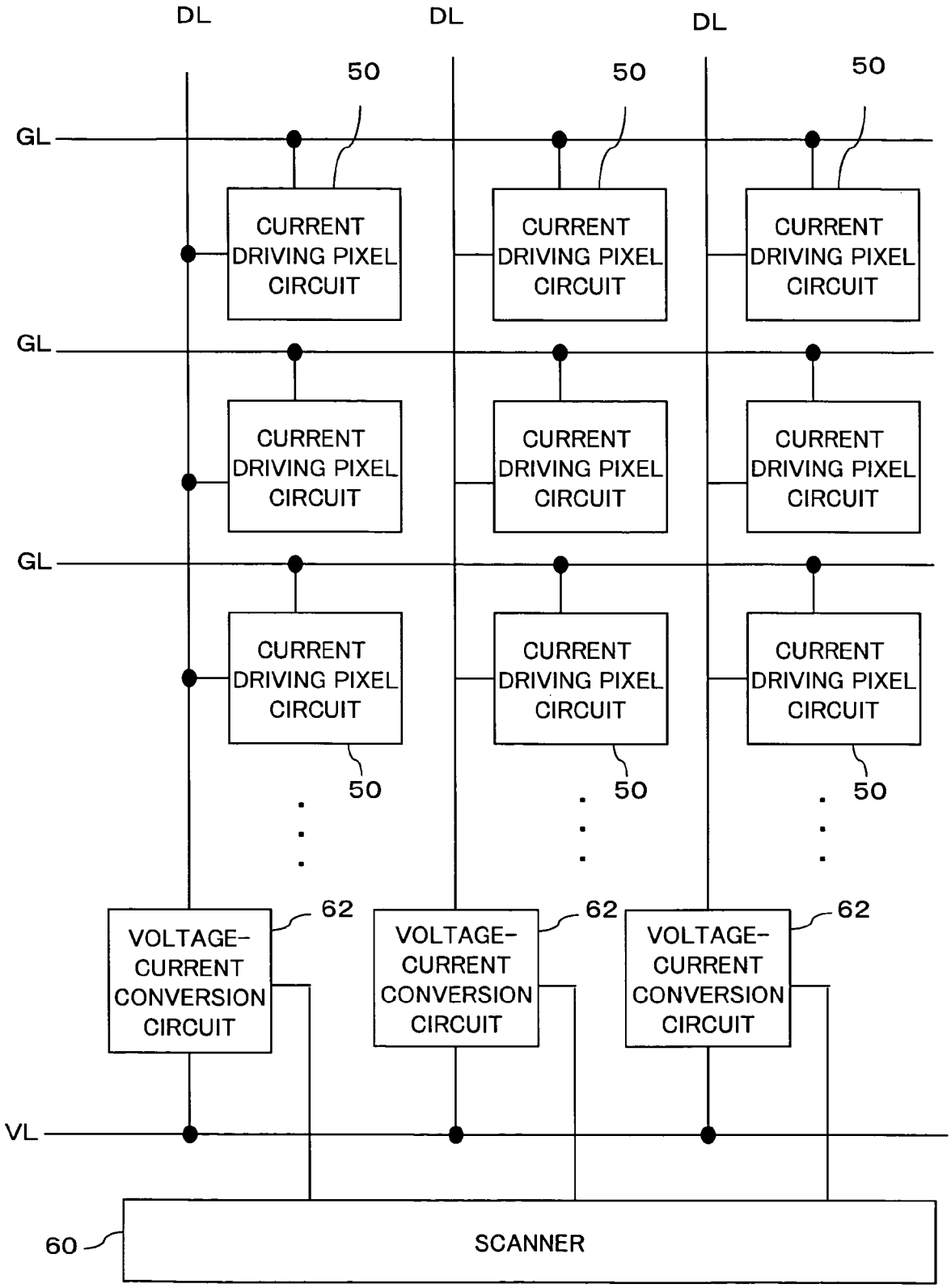
FIG. 1 is a block diagram showing an overall configuration of a display device according to an embodiment of the present invention.

FIG. 1 shows an overall configuration of an embodiment in which current driving pixel circuits 50 are arranged in a matrix to form a display region. The pixel circuit 50 including an organic EL element and a TFT controlling the driving of the organic EL element, as described hereinafter, is deposited on a glass substrate.

A horizontal scanner 60 and a vertical scanner (not shown) for driving the current driving pixel circuit 50 are disposed around the periphery of the substrate. These scanners are basically formed on the same substrate through the same process as the TFT and the like in the pixel circuit.

Data lines DL are arranged along a column direction (vertical direction) of the pixel circuit 50, each connected to a video signal line VL through a voltage-current conversion circuit 62, which receives a control signal from the horizontal scanner 60. A gate line GL arranged in a row direction (horizontal direction) of the pixel circuit 50 is connected to the vertical scanner. The data line DL and the gate line GL are connected to each pixel circuit 50. The pixel circuit 50 is the current driving type, and that the gate line GL is formed of two separate lines, i.e. Write and Erase, as described hereinafter.

A video signal line VL receives ordinary video signals (voltage video signal), i.e. time-series luminance information for each pixel, whose voltage is varied with the luminance. Distinct video signals are used for three colors of R, G, and B, and separately provided to pixel circuits, each corresponding to R, G, or B. For example, the color R, G, or B may be assigned to each data line DL, and the pixel connected to the data line DL may be used as the pixel circuit emitting light of the color provided to the corresponding data line DL.

In such a circuit, when a video signal (voltage video signal) is supplied to the video signal line VL, the horizontal gate line GL corresponding to the supplied video signal is selected, rendering the corresponding pixel circuit 50 data writable state. In this state, the horizontal scanner 60 sends a control signal to the voltage-current conversion circuit 62 connected to the data line corresponding to the provided video signal, and the circuit 62 converts the video signal which is a voltage signal into a current signal (current video signal), and sequentially supplies the converted signal to the data lines DL. More specifically, the horizontal scanner 60 sends the control signal to the relevant voltage-current conversion circuit 62 based on a dot clock corresponding to the pixel-by-pixel luminance data of the video signal, and the supplied voltage video signal is converted into a current data signal (current video signal) to be supplied to the data line DL. Data is written by means of the current data signal into the pixel circuit 50 connected to that data line DL and selected by the gate line GL, thereby causing light emission of the organic EL element in that pixel circuit 50. The voltage-current conversion circuit 62 outputs the current data signal for substantially one horizontal period, causing the pixel circuit in which data is written emits light for substantially one frame.

Because the voltage-current conversion circuit 62 is thus provided corresponding to each data line DL, for the video signal supplied to the display device ordinary voltage video signals can be used, which are converted to the current data signal to drive the current driving pixel circuit 50.

Figure 2:
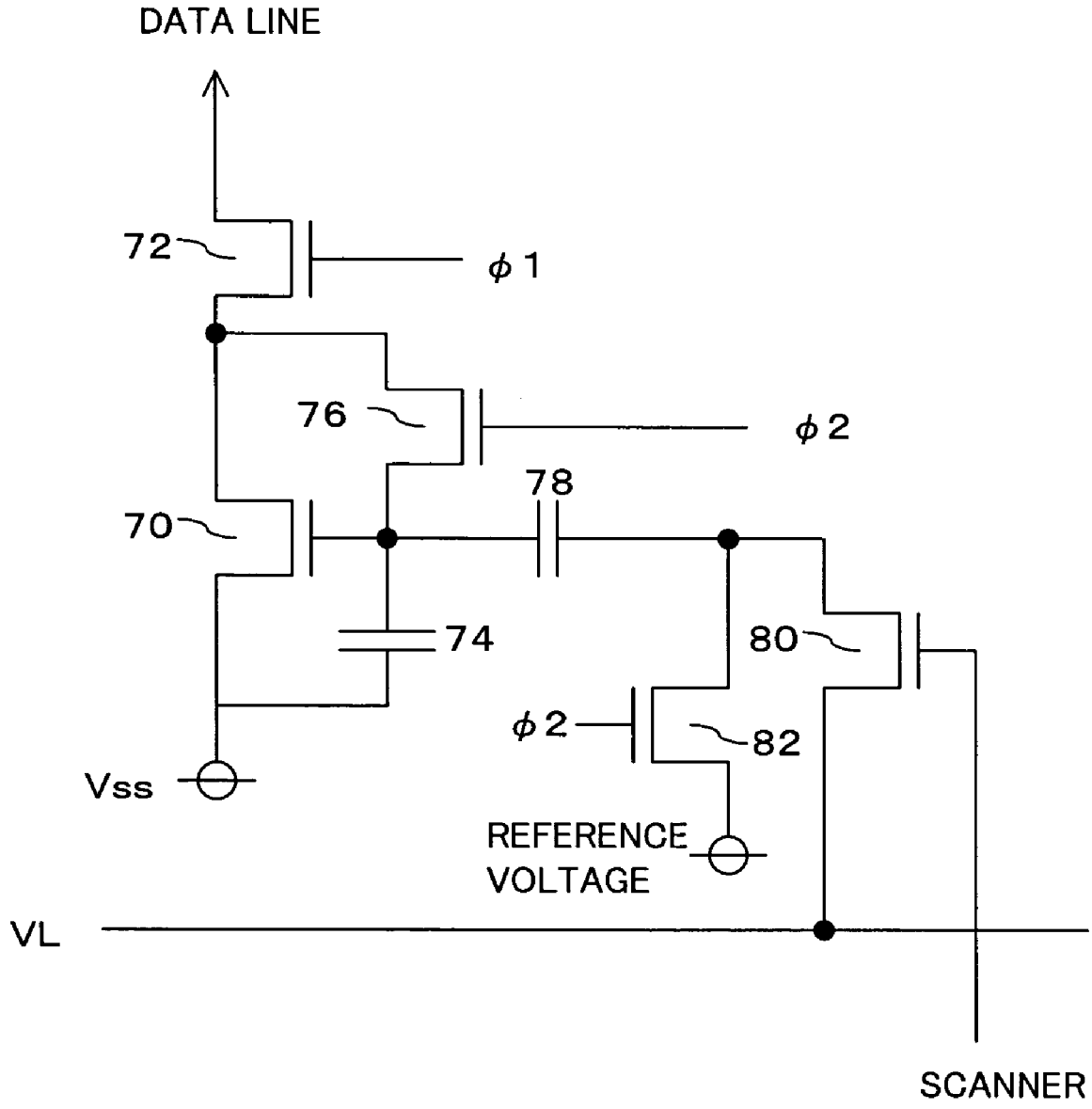
FIG. 2 shows an exemplary configuration of a voltage-current conversion circuit.

FIG. 2 shows an exemplary configuration of the voltage-current conversion circuit 62. An n-channel TFT 70 has a source connected to a power source Vss, and a drain connected to a source of an n-channel TFT 72 whose drain is connected to the data line DL.

The source and gate of the TFT 70 are connected by a capacitor 74, and the drain and gate thereof are connected by another n-channel TFT 76.

The gate of the TFT 70 is connected through a capacitor 78 and an n-channel TFT 80 to the video signal line VL for supplying the voltage video signal.

A connection node of the capacitor 78 is connected to a power source at a reference voltage (a zero voltage of the video signal or a greater predetermined voltage) through the n-channel TFT 82.

The gate of the TFT 72 receives a signal $\phi$1, the gates of the TFTs 76 and 82 receive a signal $\phi$2, and the gate of the TFT 80 receives a selection signal from the horizontal scanner 60.

Figure 3:
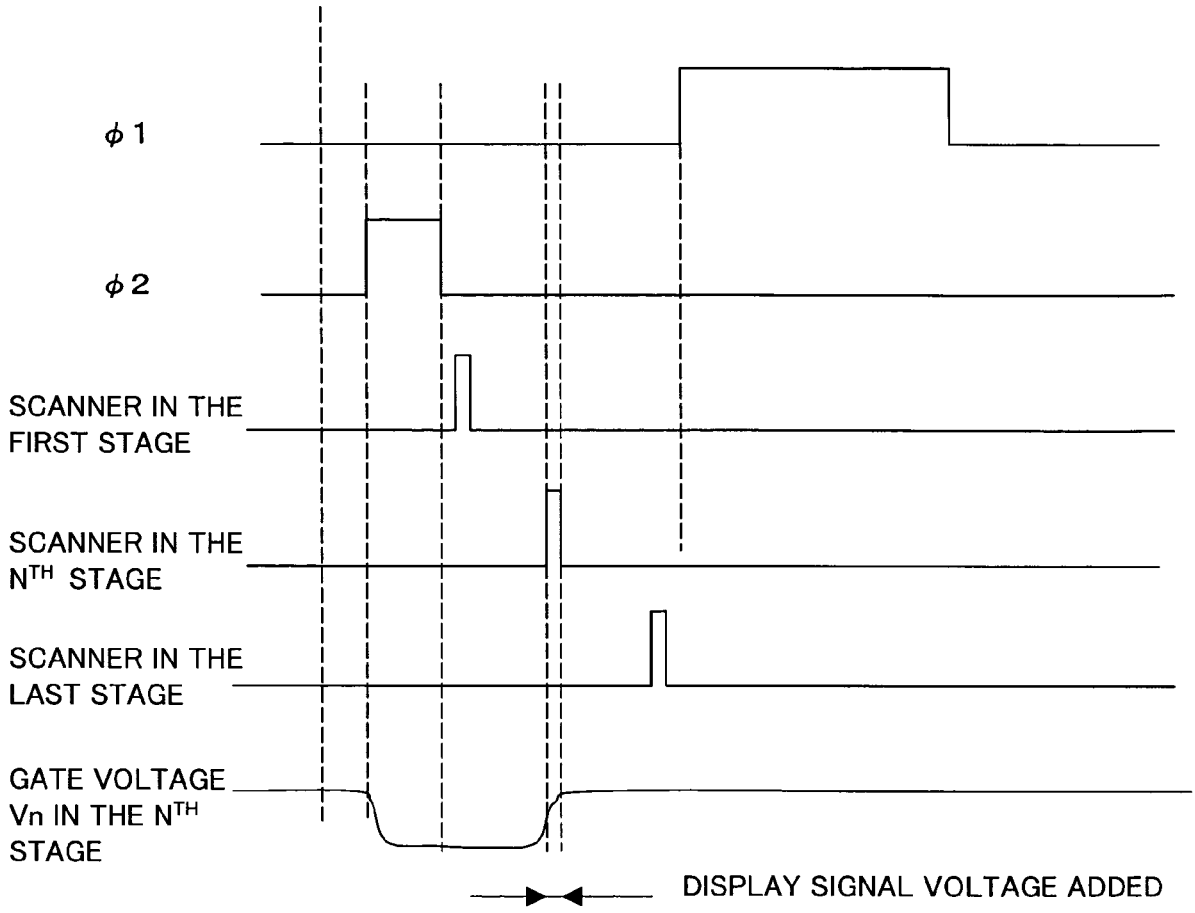
FIG. 3 is a timing chart for describing operation of the voltage-current conversion circuit shown in FIG. 2.

Operation of the above-described current conversion circuit 62 will be described with reference to FIG. 3. In the beginning of one horizontal period (1H), the signal $\phi$2 is rendered high (H), turning on the TFT 82, whereby the reference voltage is supplied to one end of the capacitor 78.

The high signal $\phi$2 turns on the TFT 76, creating a short circuit between the drain and gate of the TFT 70. As a result, the TFT 70 functions as a diode, and the gate-source voltage is set at a threshold voltage of the TFT 70. Consequently, the difference between the reference voltage and the threshold voltage is held in the capacitor 78.

Next, when the signal $\phi$2 is rendered low (L), the TFTs 76 and 82 are turned off, and in this state the horizontal scanner 60 sequentially supplies a high control signal to the voltage-current conversion circuit 62 in each column in synchronism with the timing of the video signal (display signal) of the video signal line. As a result, the TFT 80 turns on and a display signal voltage is added at one end of the capacitor 78 to increase the gate voltage of the TFT 70. In this example, a pixel circuit in the $n^{th}$ stage is shown, and therefore the display voltage at this moment is sequentially supplied to the capacitor 78 in each stage by a signal from the scanner in the $n^{th}$ stage column. Consequently, the display voltage is added to the gate voltage Vn of the TFT 70. Although the change of the gate voltage Vn of the TFT 70 is not exactly the same as the display voltage itself because the charge level of the capacitor 74 is varied, this will have no negative effects because the variation can be reduced by capacitance setting of the capacitors 74 and 78, and because the change of the gate voltage is amplified by the TFT 70.

When writing of the display voltage (data voltage) for one line is finished, the signal $\phi$1 is rendered H for a predetermined period, turning on the TFT 72, and the current in accordance with the gate voltage Vn is supplied to the TFT 70 and the data line DL.

As described above, the voltage-current conversion circuit 62 in the present embodiment sets the threshold voltage of the TFT 70 at the gate thereof in the beginning of the period 1H, and drives the TFT 70 by adding the display voltage to the set threshold voltage. As a result, variation in threshold voltage of the TFT 70 of each stage (column), if any, will not affect the amount of current supplied to the data line DL.

The TFT 82 may be eliminated if the reference voltage is set in the video signal line VL and the TFT 80 is turned on to set the reference voltage at one end of the capacitor 78. Further, the gate voltage setting of the TFT 70 can be more ensured by the configuration where initial current is supplied to the TFT 70 from a constant current source, a constant voltage source, or the like when the TFT 76 is turned on. While n-channel TFTs are used in the above description, another configuration can be easily achieved with all p-channel TFTs by changing, for example, the polarity of signals.

Figure 4:
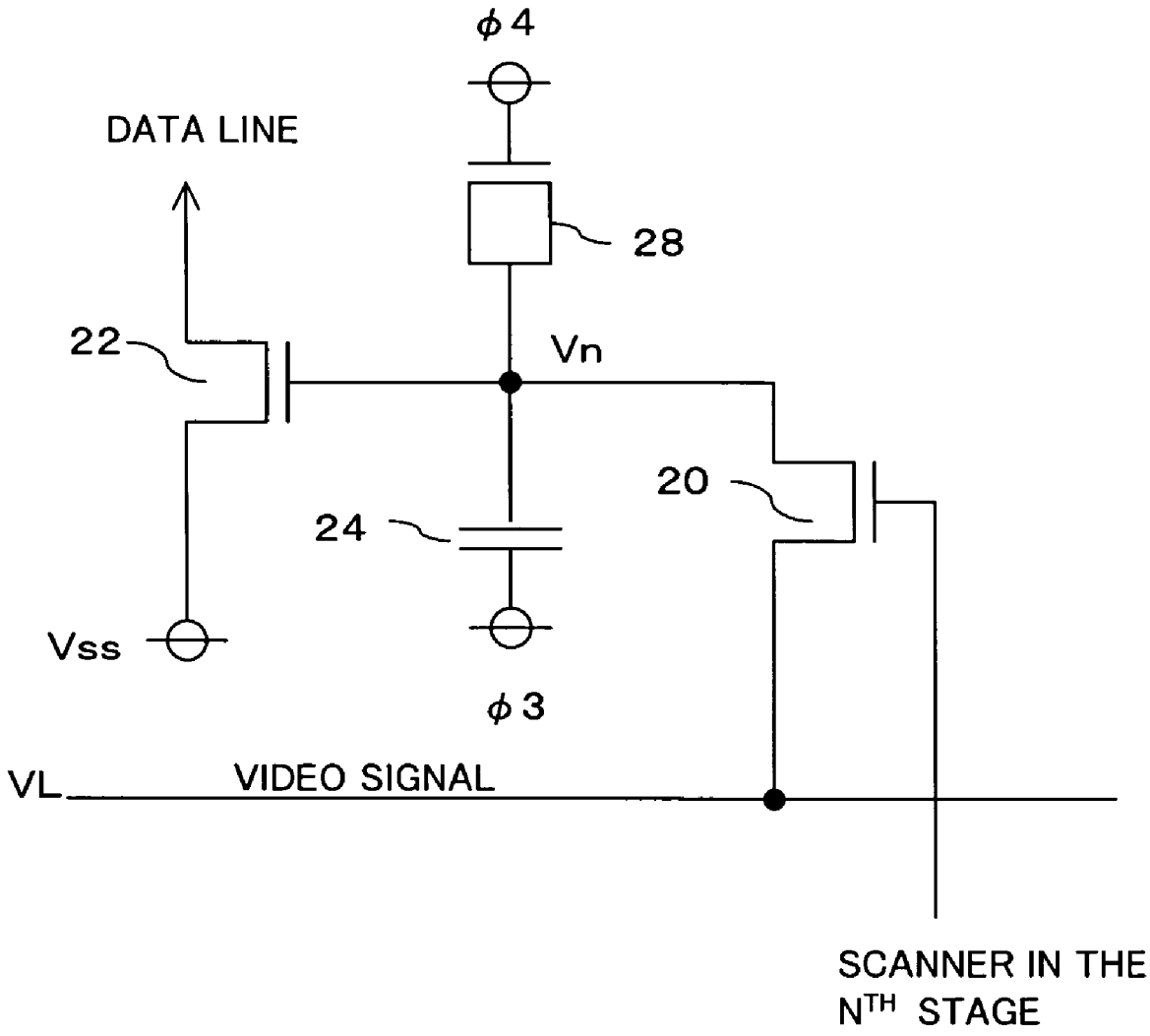
FIG. 4 shows another exemplary configuration of a voltage-current conversion circuit.

FIG. 4 shows another exemplary configuration of the voltage-current conversion circuit 62. The video signal line VL is connected to a drain of an n-channel TFT 20 whose gate receives a control signal from a scanner in the $n^{th}$ stage column, and source is connected to a gate of an n-channel output TFT 22. The gate of the output TFT 22 to which the source of the TFT 20 is connected is connected to one end of a capacitor 24, whose other end is connected to a pulse drive line $\phi$3.

The output TFT 22 has a source connected to an EL power source line extending in the vertical direction, and a drain connected to the data line DL.

The gate of the output TFT 22 is connected to one end of an n-channel MOS capacitor element 28 whose gate end is set at a reference power source line voltage at a predetermined potential. It should be noted that the MOS capacitor element 28 having source, channel, and drain regions similar to ordinary TFTs is used simply as a gate capacitor by connecting one of the source and drain electrodes and the gate electrode to predetermined portions. MOS capacitor element 28 may have a channel region and an impurity region electrode, which together with the gate electrode are connected to predetermined portions. Examples of the MOS capacitor element 28 include an MOS transistor, an MIS transistor, and a TFT type.

In the voltage-current conversion circuit 62 of the above configuration, the selection signal from the scanner 60 is rendered H to turn on the TFT 20 when a display signal for the corresponding pixel is sent among the video signals for one line supplied to the video signal line VL. Consequently, the display voltage of the video signal at this moment is supplied to and held in the capacitor 24, and the gate voltage of the output TFT 22 is maintained even when the selection signal goes L to turn off the TFT 20.

The output TFT 22 operates in accordance with the voltage maintained in the capacitor 24 to cause the corresponding data current to flow through the data line DL.

The voltage-current conversion circuit 62 in each column sequentially receives the video signal, and the data current for one line is output. This operation is sequentially repeated.

The output TFT 22 begins current flow when the difference between the power source Vss and the gate voltage, i.e. Vgs, exceeds a threshold voltage Vth determined by the properties of the TFT, with the amount of current being determined by the difference between the gate voltage and the threshold voltage.

In this embodiment, the gate of the output TFT 22 is connected to the MOS capacitor element 28 and the other end of the capacitor 24 is connected to the pulse drive line ϕ3, thereby compensating for variation in threshold voltage of the output TFT 22 in each voltage-current conversion circuit 62.

When the TFT 20 is ON and the data voltage is written, the pulse drive line ϕ3 is at the L level and a reference power source line ϕ4 is at the H level. After writing of the data voltage (charging of the capacitor 24) is finished to turn off the TFT 20, the pulse drive line ϕ3 is changed to the H level. Consequently, a signal voltage including the added threshold voltage is generated as the gate voltage of the output TFT 22. Alternatively, by changing the reference voltage ϕ4 to the L level simultaneously with the change in line ϕ3 to the H level, the output TFT 22 may be adjusted to provide an appropriate current output.

Meanwhile, the MOS capacitor element 28 is formed adjacent to the output TFT 22 at the same manufacturing step as the TFT 22. Consequently, the output TFT 22 and the MOS capacitor element 28 have substantially the same impurity concentration and the threshold voltage. The reference voltage ϕ4 to which the gate of the MOS capacitor element 28 is connected is set so that the channel region of the MOS capacitor element 28 is changed from the ON state to the OFF state when the voltage of the above pulse drive line is changed from L to H. After the data voltage has been written, the reference voltage ϕ4 may be simultaneously changed from H to L, while maintaining the pulse drive line ϕ3 at a constant voltage, in order to change the channel region of the MOS capacitor element 28 from the ON state to the OFF state. Alternatively, the pulse drive line ϕ3 and the reference voltage ϕ4 may be simultaneously changed from L to H and from H to L, respectively. In this case, similar effects can be enjoyed by adjusting the pulse width and the element size.

Figure 5:
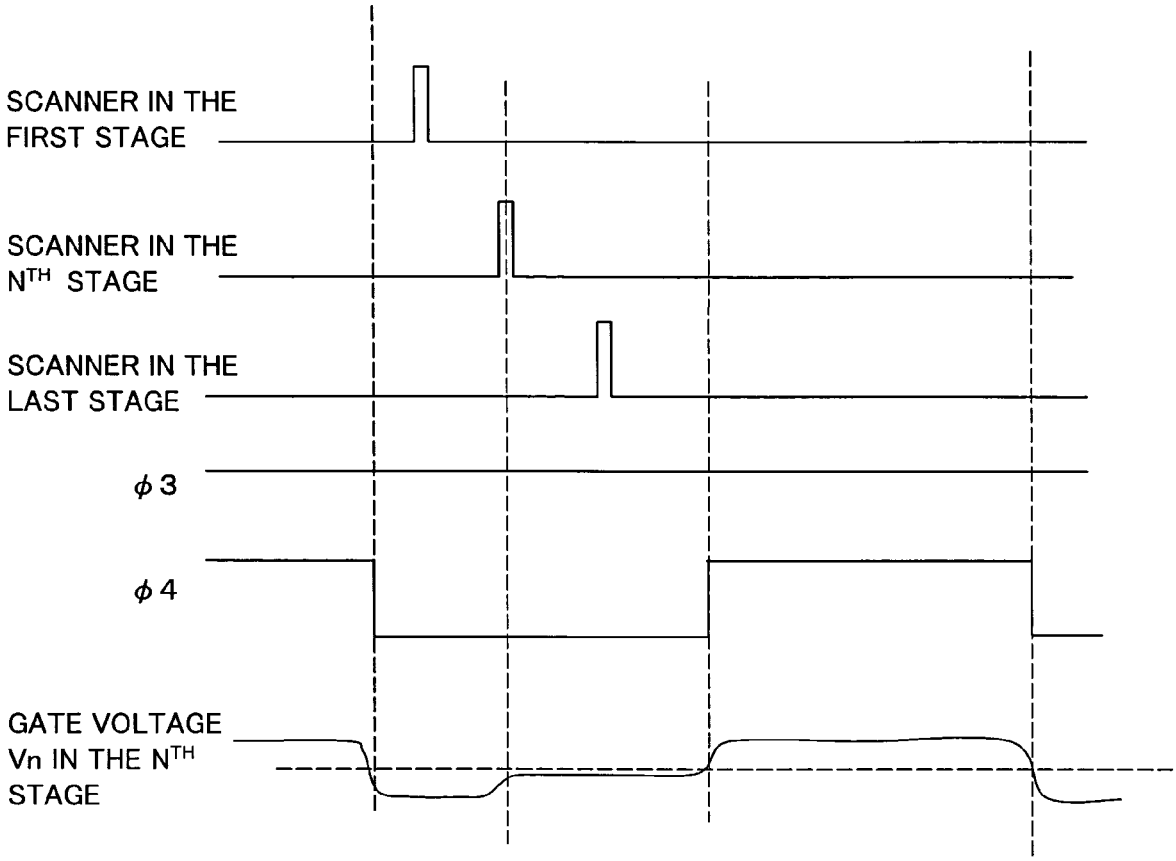
FIG. 5 is a timing chart for describing operation of a voltage-current conversion circuit.

FIG. 5 shows an example in which the voltage ϕ3 is pulse input and the voltage ϕ4 is a constant potential. The voltage ϕ4 is a voltage higher than that input as the video signal. When the voltage ϕ3 is at the level 1, the control signal attaining an H level is sequentially provided to the voltage-current conversion circuit 62 in each column by the horizontal scanner 60, and the display voltage in the video signal line VL is charged at the gate of the output TFT 22. The gate voltage of the output TFT 22 at this moment is set so that it does not reach the voltage that turns on the TFT 22.

By changing the signal ϕ3 from the L level to the H level, the gate voltage of the TFT 22 is increased. The ON/OFF state of the MOS capacitor element 28 is changed, thereby compensating for variation in the threshold voltage of the TFT 22.

Figure 6:
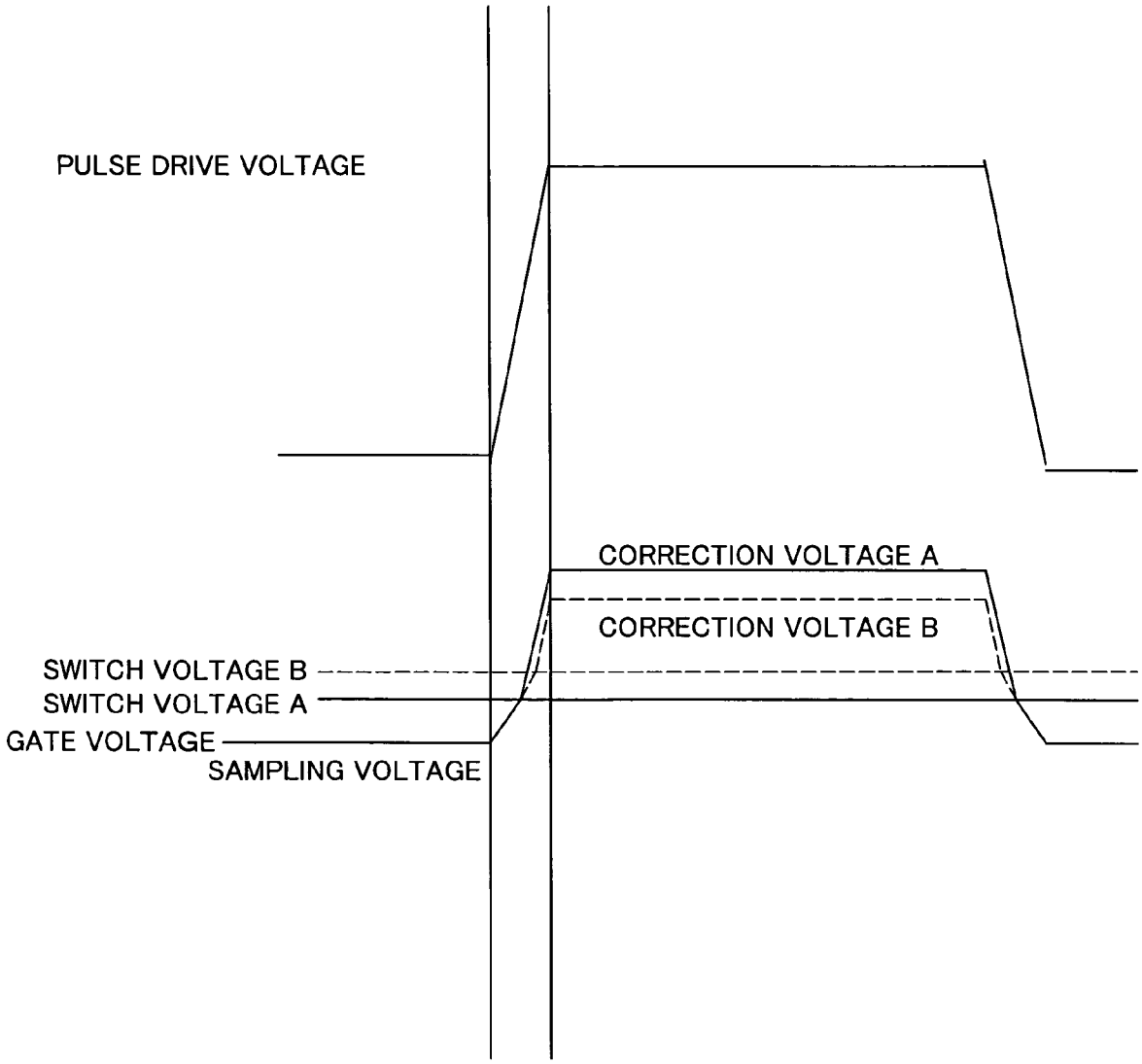
FIG. 6 is a diagram for describing operation of a voltage-current conversion circuit.

As illustrated in FIG. 6, the pulse drive voltage of the pulse drive line is changed from the L level to the H level, thereby increasing the gate voltage of the output TFT 22 in accordance with the pulse driven voltage. When the gate voltage is elevated to the threshold voltage of the MOS capacitor element 28, the element 28 is changed from the ON state to the OFF state. Consequently, the capacitance of the MOS capacitor element 28 is reduced to increase the effects of the change in pulse drive voltage input through the capacitor 24, thereby increasing the angle of slope in the gate voltage. In other words, the gate potential is changed in accordance with the change in pulse drive voltage. The capacitance of the MOS capacitor element 28 is larger in the ON state, and smaller in the OFF state. The change in gate potential becomes more considerable when the capacitor is switched to have a reduced capacitance.

Consequently, if the switch voltage at which the MOS capacitor element 28 is switched from the ON state to the OFF state is a "switch voltage A" in FIG. 6, the gate voltage is changed as indicated by a solid line in FIG. 6, changing at a first slope up to the switch voltage A and thereafter at a second slope, and the gate voltage is set at a correction voltage A when the pulse drive voltage attains the H level. The switch voltage at which the MOS capacitor element 28 is turned ON or OFF is determined by the difference from the reference voltage, and therefore the switch voltages A and B are the voltages obtained by subtracting the absolute value of the threshold voltage Vth of the MOS capacitor element 28 from the reference voltage (reference voltage−|Vth|).

On the other hand, when the threshold voltage of the MOS capacitor element 28 is the "switch voltage B" higher than the "switch voltage A", the gate voltage is changed as indicated by a broken line in FIG. 6, at a first slope up to the switch voltage B and at a second slope thereafter, and the gate voltage is set at a correction voltage B when the pulse drive voltage attains the H level. In other words, although the same data voltage is supplied, the gate voltage set by the pulse drive is set smaller as the absolute value of the threshold voltage is decreased.

As described above, the threshold voltage of the output TFT 22 is the same as the threshold voltage of the MOS capacitor element 28. Therefore, when the threshold voltage of the output TFT 22 is the "threshold voltage 1", the gate voltage is set at the correction voltage for the threshold voltage 1. When the threshold voltage of the output TFT 22 is the "threshold voltage 2", the gate voltage is set at the correction voltage for the threshold voltage 2. In this example, the differences between the threshold voltages and the gate voltages are substantially same. That is, even though the threshold voltage of the output TFT 22 is different, the difference between the threshold voltage and the gate voltage can be maintained constant as long as the data voltage is fixed through setting of the size of the MOS capacitor element 28, the reference voltage, the size of the output TFT 22, the capacitance of the capacitor 24, and the like, thereby eliminating effects of variation in threshold voltage.

In order to effect the above-described compensation, conditions must be set so that the second slope is twice as steep as the first slope. This will be described with reference to FIG. 7. As illustrated, when the MOS capacitor element 28 is in the ON state, the capacitance thereof is greater than the capacitance in the OFF state, and therefore the effects of change in pulse drive voltage are suppressed and the angle of the slope of change in the gate voltage is small. Meanwhile, when the MOS capacitor element 28 is in the OFF state, the capacitance thereof is small, the effects of change in pulse drive voltage are significant, and the slope is steeper. Because the slope is set twice as steep, the increase in gate voltage when the pulse drive voltage attains the H level is twice as great in the OFF state as that in the ON state of the MOS capacitor element 28.

Figure 7:
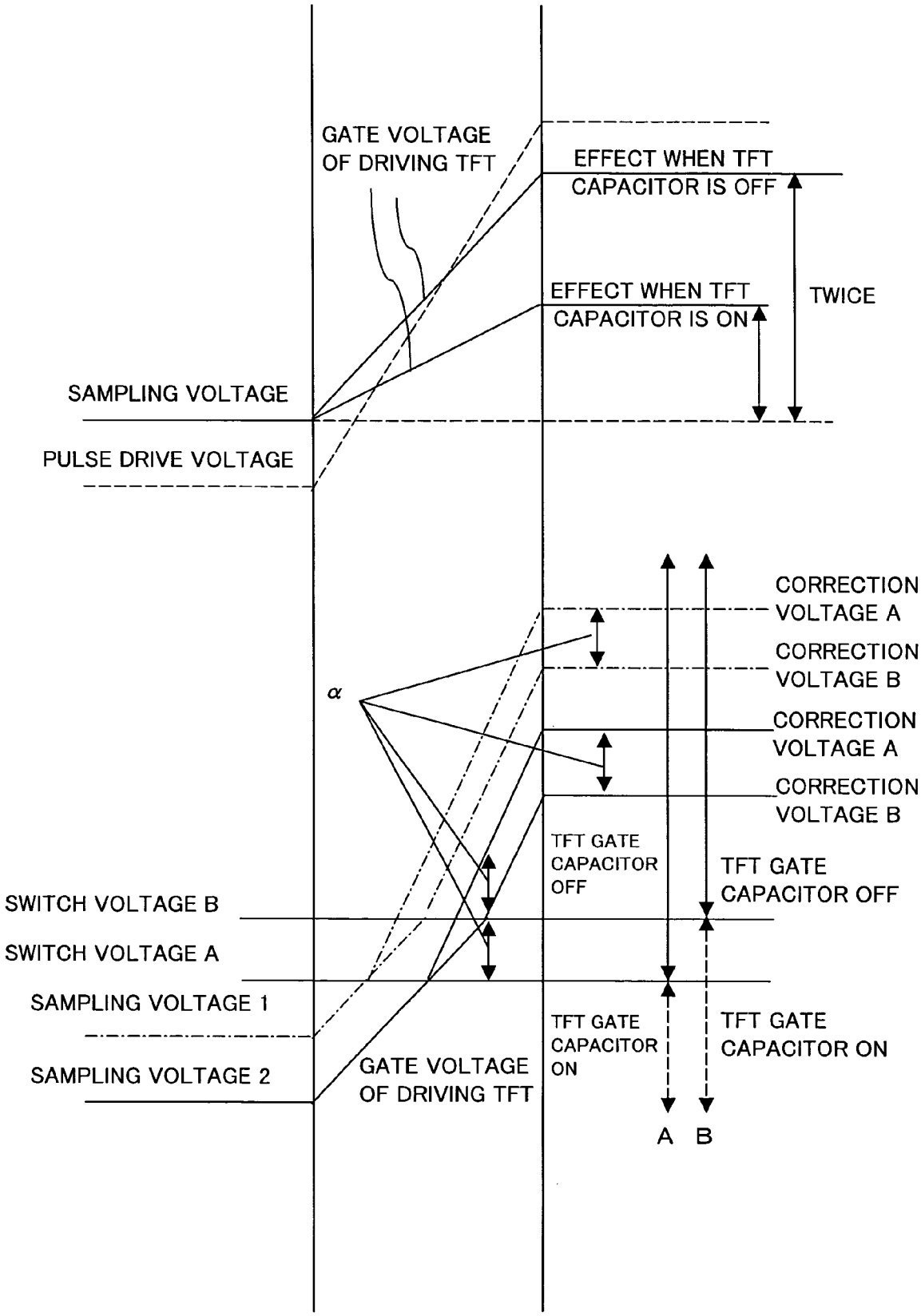
FIG. 7 is a diagram for describing operation of a voltage-current conversion circuit.

In actual practice, the gate voltage is increased at the first slope up to the switch voltage A, when the output TFT switches at the voltage A, and thereafter at the second slope twice as steep as the first slope, as illustrated in FIG. 7. When the output TFT switches at the voltage B, the gate voltage increases at the first slope up to the switch voltage B, and therefore a difference $\alpha$ between the gate voltages when the gate voltage is changed to the switch voltage B is the difference between the correction voltages A and B. Because the second slope is twice as steep as the first slope, the difference $\alpha$ is equal to the difference between the switch voltages A and B. Therefore, the difference between the switch voltages is the same as the difference between the correction voltages, thereby compensating for the effects of variation in switch voltage (i.e. threshold voltage).

As illustrated, even when a sampling voltage which is a writing voltage of the data voltage is changed, the switch voltage difference is similarly the same as the correction voltage difference, so that the variation in threshold voltage can always be compensated. The potential difference of the sampling voltage itself is amplified twice after the compensation operation.

As described above, according to the present embodiment, when the voltage of the pulse drive line is changed, the output TFT 22 is turned on, the MOS capacitor element is switched ON/OFF, and the capacitance thereof is changed. The gate voltage of the driving transistor at which the MOS capacitor element is switched ON/OFF is changed in accordance with the change in threshold of the MOS capacitor element. That is, the change in gate voltage of the driving transistor in accordance with the change in pulse drive line depends on the capacitance of the MOS capacitor element, and therefore the gate voltage is changed in accordance with the change in threshold of the MOS capacitor element. Consequently, by designing the MOS capacitor element, the capacitor, and the like so that the gate voltage of the driving transistor changes to cancel the variation in threshold of the driving transistor, effects of the variation in threshold of the driving transistor on the data current can be reduced.

Also in this embodiment, each TFT may have a p-channel.

An exemplary configuration of the pixel circuit 50 of the current driving type will be described with reference to FIG. 8. As illustrated, one end of a p-channel TFT (selection TFT) 3 having a gate connected to a gate line Write is connected to a data line DL for supplying data current Iw from a current source CS (corresponding to the voltage-current conversion circuit 62), and the other end thereof is connected to each one end of a p-channel TFT 1 and a p-channel TFT (driving TFT) 4. The other end of the TFT 1 is connected to a power source line PVDD, and a gate thereof is connected to a gate of a p-channel TFT 2 for driving an organic EL element OLED. The other end of the TFT 4 is connected to the gates of the TFTs 1 and 2, which are connected to the power source line PVDD through a storage capacitor C. The gate of the TFT 4 is connected to the gate line Erase.

With this configuration, the TFT 3 is turned on when the line Write attains the L level, and the TFT 4 is turned on when the line Erase attains the L level. The data current Iw is supplied to the data line Data. As a result, a short circuit is made between the gate and source of the TFT 1, causing the current Iw to flow to the TFTs 1 and 3. The current Iw is converted into the voltage, which is set at the gates of the TFTs 1 and 2. After the TFTs 3 and 4 are turned off, the gate voltage of the TFT 2 in the storage capacitor C is maintained. Consequently, the current corresponding to the current Iw continues to flow through the TFT 2, causing the organic EL (OLED) to emit light. When the line Erase attains the L level, the TFT 4 is turned on to increase the gate voltage of the TFT 1 and discharge the storage capacitor C, thereby erasing data and turning off the TFTs 1 and 2.

According to this circuit, when the current is supplied to the TFT 1, the corresponding current is also supplied to the TFT 2 which forms a current mirror with the TFT 1. The gate voltages of the TFTs 1 and 2 are determined in this state, and maintained in the storage capacitor C, and the amount of current in the TFT 2 is determined in accordance with the voltage.

Figure 8:
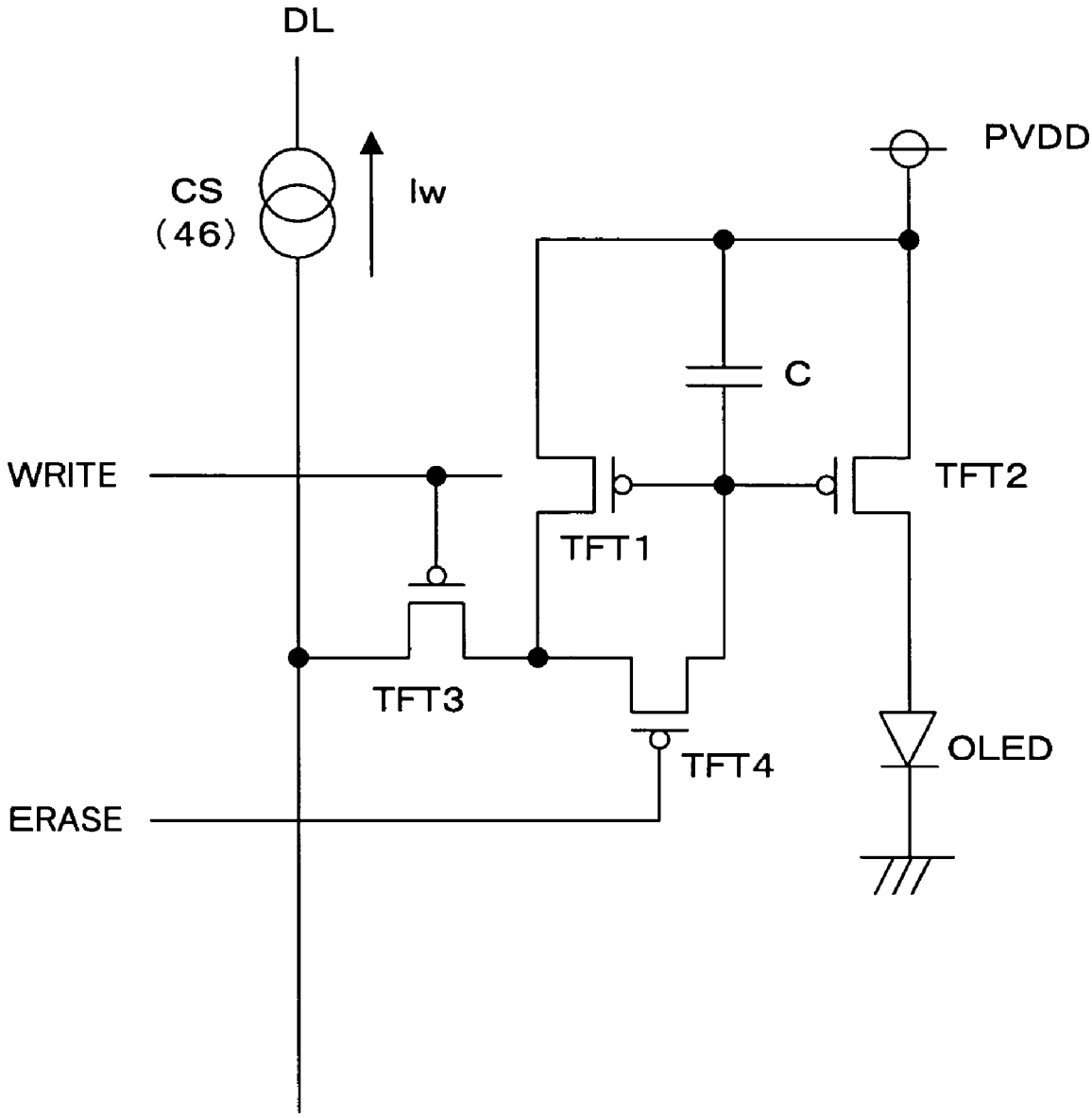
FIG. 8 shows an exemplary configuration of a pixel circuit.

It should be noted that the configuration shown in FIG. 8 is only one example, and that any of the widely proposed current driving pixel circuits in various forms may be used.

According to the present embodiment, the compensation circuit is provided to prevent inaccurate output of the current signal even when the threshold voltage of the current conversion circuit is different from a predetermined voltage. Further, the display device simply receives an ordinary video signal which is a voltage signal from an external source, thereby achieving display with the current driving pixel circuits using ordinary video signals.

Another embodiment of the present invention will next be described. In this embodiment, the input voltage video signal is digital data composed of plural bits of 0 and 1.

Figure 9:
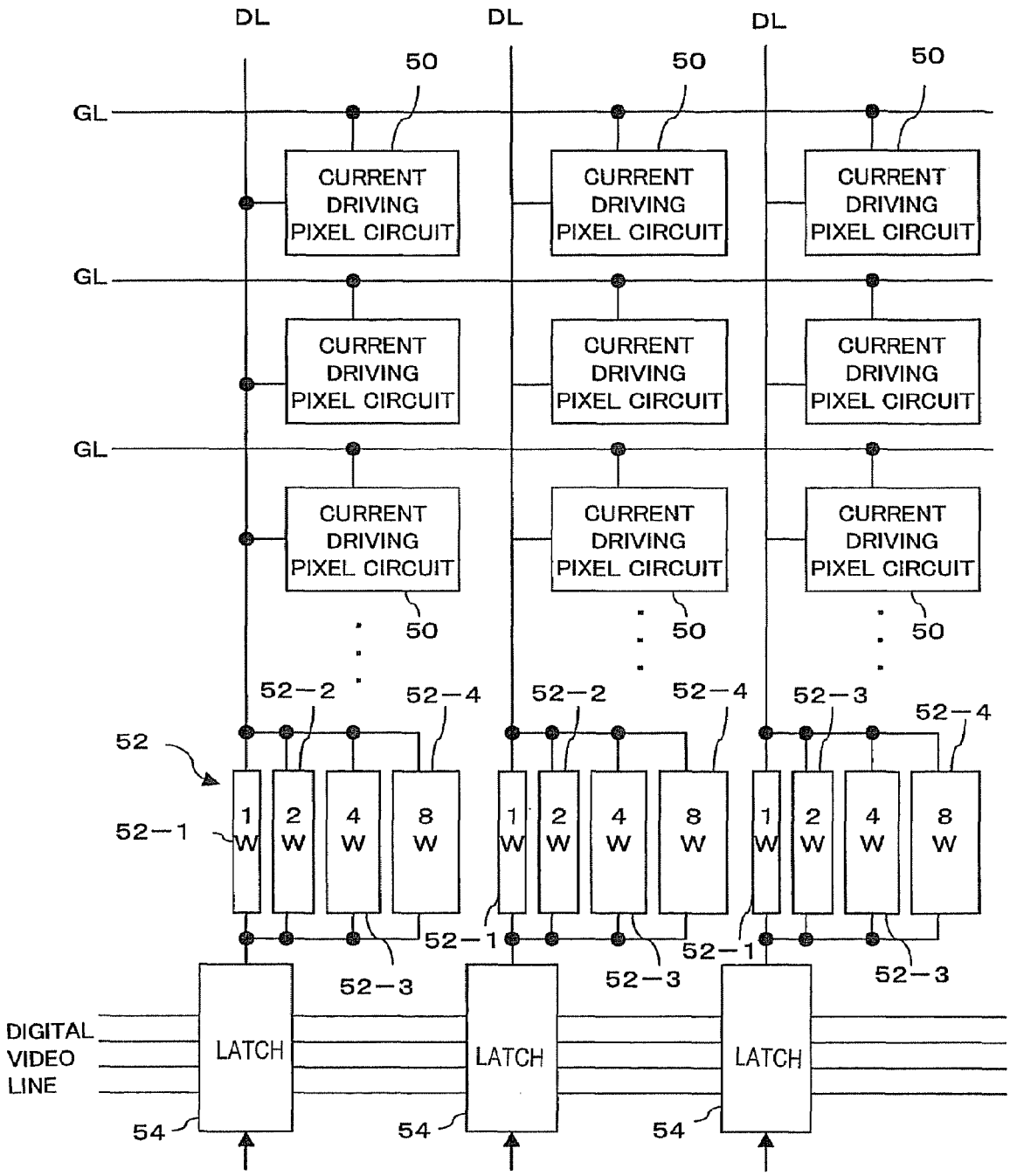
FIG. 9 is a block diagram showing an overall configuration of a display device according to another embodiment of the present invention.

FIG. 9 shows an overall configuration according to one example, in which the current driving pixel circuits 50 are arranged in a matrix to form the display region. The basic configuration is the same as that shown in FIG. 1, and this pixel circuit 50 includes an organic EL element and a TFT for controlling how to drive the element as described hereinafter, and is deposited on a glass substrate.

In a peripheral region of the substrate, horizontal and vertical scanners (not shown) are disposed for driving the current driving pixel circuit 50. These scanners are basically formed on the same substrate through the same process as the TFTs and the like of the pixel circuit.

The data line DL is disposed in the column direction (vertical direction) of the pixel circuit 50, and each data line DL is connected to four current generating circuits 52-1, 52-2, 52-3, and 52-4. These four current generating circuits 52-1, 52-2, 52-3, and 52-4 generate current of the magnitudes 1, 2, 4, and 8, respectively, and output thereof is controlled by a control signal from a latch 54 for latching a 4-bit digital video signal.

The latch 54 is composed of four registers, and latches 4-bit data supplied to the digital video line. More specifically, the four current generating circuits 52-1, 52-2, 52-3, and 52-4 correspond to 0, 1 of each bit of the 4-bit digital video signal on the digital video line so as to control whether or not to generate current of the magnitude 1, 2, 4, and 8. A current in accordance with the digital video data value is output from the current generating circuits 52-1 through 52-4, and supplied to the data line DL. The latch 54 in each column receives the control signal from the horizontal scanner, and latches data at the timing when the corresponding digital video data is supplied. This operation is the same as that of commonly-used horizontal scanners treating analog video signals, and the control signal is generated by transferring the H level to a shift register forming the horizontal scanner by a data clock corresponding to video data transfer.

The gate line GL is arranged along the row direction (horizontal direction) of the pixel circuit 50, and connected to the vertical scanner. The vertical scanner selects the gate line GL corresponding to the supplied digital video data.

The data line DL and the gate line GL are connected to each pixel circuit 50. The pixel circuit 50 is of the current driving type, and the gate line GL is formed of two separate lines, Write and Erase, as described hereinafter.

The digital video line receives time-series luminance information for each pixel as digital 4-bit (16-tone) data. The video signals, usually provided separately for three colors of R, G, and B, are supplied in parallel through digital video lines separately provided for R, G, and B. The individual video data for R, G, or B is separately supplied to the pixel circuit 50 corresponding to R, G, or B. For example, the data line DL may be assigned the color of R, G, or B, so that the pixel connected to the data line DL may function as the pixel circuit emitting light of the color supplied to the corresponding data line DL.

In such a circuit, when the digital video signal is transmitted to the digital video line, the horizontal gate line GL corresponding to that video signal is selected, turning the corresponding pixel circuit 50 into a data writable state. In this state, the horizontal scanner transmits a control signal to the latch 54 corresponding to the supplied video signal, and the latch 54 sequentially takes in the digital video signal.

The outputs of the corresponding current generating circuits 52-1 through 52-4 are controlled by the value 0 or 1 of the data supplied to the latch 54, and the current corresponding to the digital video signal is supplied to the data line DL.

Data is written through a current data signal into the pixel circuit 50 connected to the data line DL and selected by the gate line GL, and the organic EL element of that pixel circuit 50 correspondingly emits light. The current generating circuit 52 (52-1 through 52-4) outputs the current data for substantially one horizontal period, causing the pixel circuit to which data is written emits light for substantially one frame.

As described above, the current generating circuit 52 is provided corresponding to each data line DL, and output of the circuit 52 is controlled by the latch 54. Consequently, as the video signal supplied to the display device, a digital video signal may be used, which is converted into a predetermined current data signal for driving the pixel circuit 50 of the current driving type.

Although digital signals are less likely to deteriorate as they travel through transmission paths and therefore create a display with smaller variation can be achieved because the pixel circuit 50 of the current driving type is used, the output current is varied when the threshold voltage of the output transistor in the current generating circuit is varied even though it is driven by digital data. In view of this variation, a circuit for compensating for the threshold voltage is provided in the current generating circuit 52 in the present embodiment.

Figure 10:
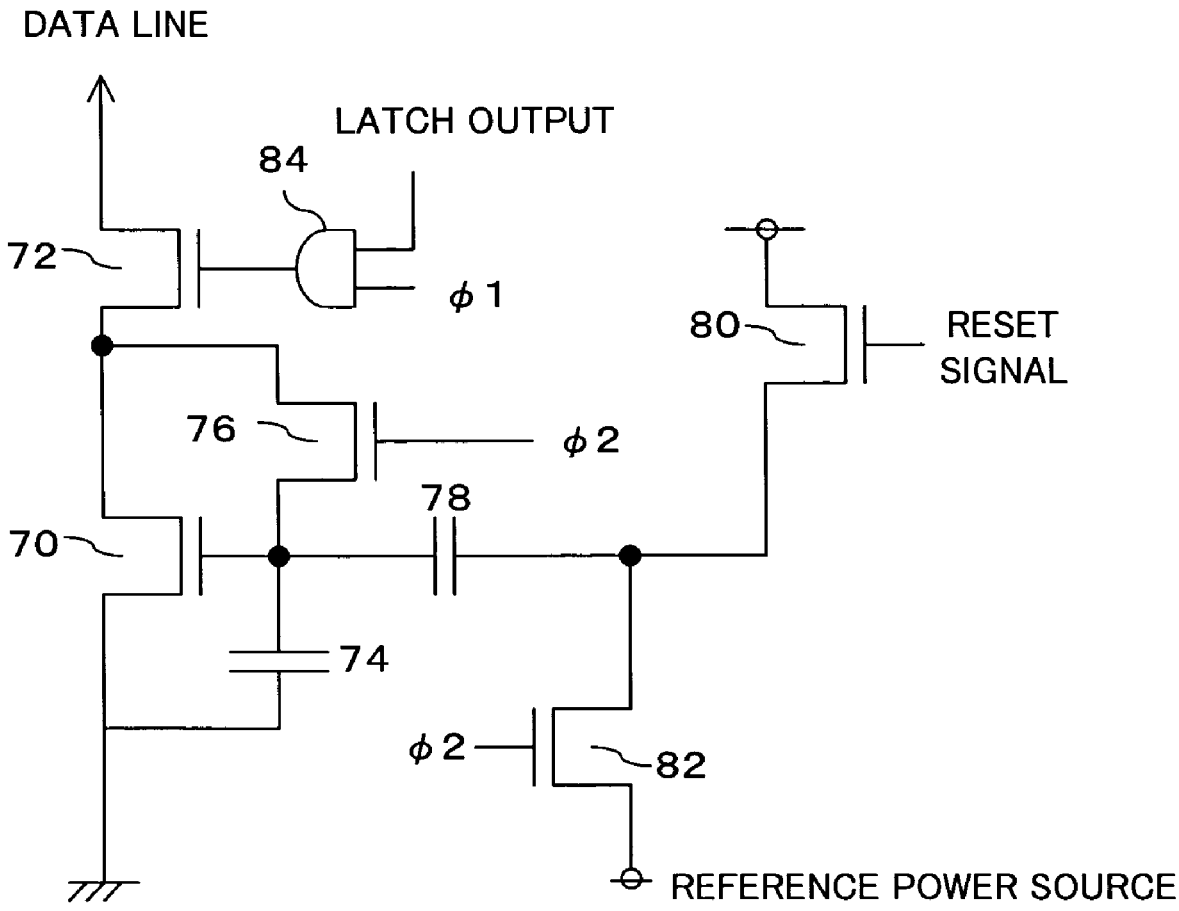
FIG. 10 shows an exemplary configuration of a current generating circuit.

FIG. 10 shows an exemplary configuration of the current generating circuit 52. While this configuration is basically the same as that shown in FIG. 2, inputs of the TFTs 72 and 80 are slightly different because input data consists of a signal of 1 or 0, and no intermediate voltage is used.

The n-channel TFT 70 has a source connected to the ground, and a drain connected to the source of the n-channel TFT 72 whose drain is connected to the data line DL.

The source and gate of the TFT 70 are connected by the capacitor 74, and the drain and gate thereof are connected by another n-channel TFT 76.

The gate of the TFT 70 is connected to the power source (ground) through the capacitor 78 and the n-channel TFT 80.

A connection node between the capacitor 78 and the TFT 80 is connected to a reference power source (such as ground) through the n-channel TFT 82.

The gate of the TFT 72 is connected to an output of an AND gate 84, which receives the signal $\phi 1$ and an output of the corresponding bit from the latch 54. The gates of the TFTs 76 and 82 receive the signal $\phi 2$, and the gate of the TFT 80 receives a reset signal.

Figure 11:
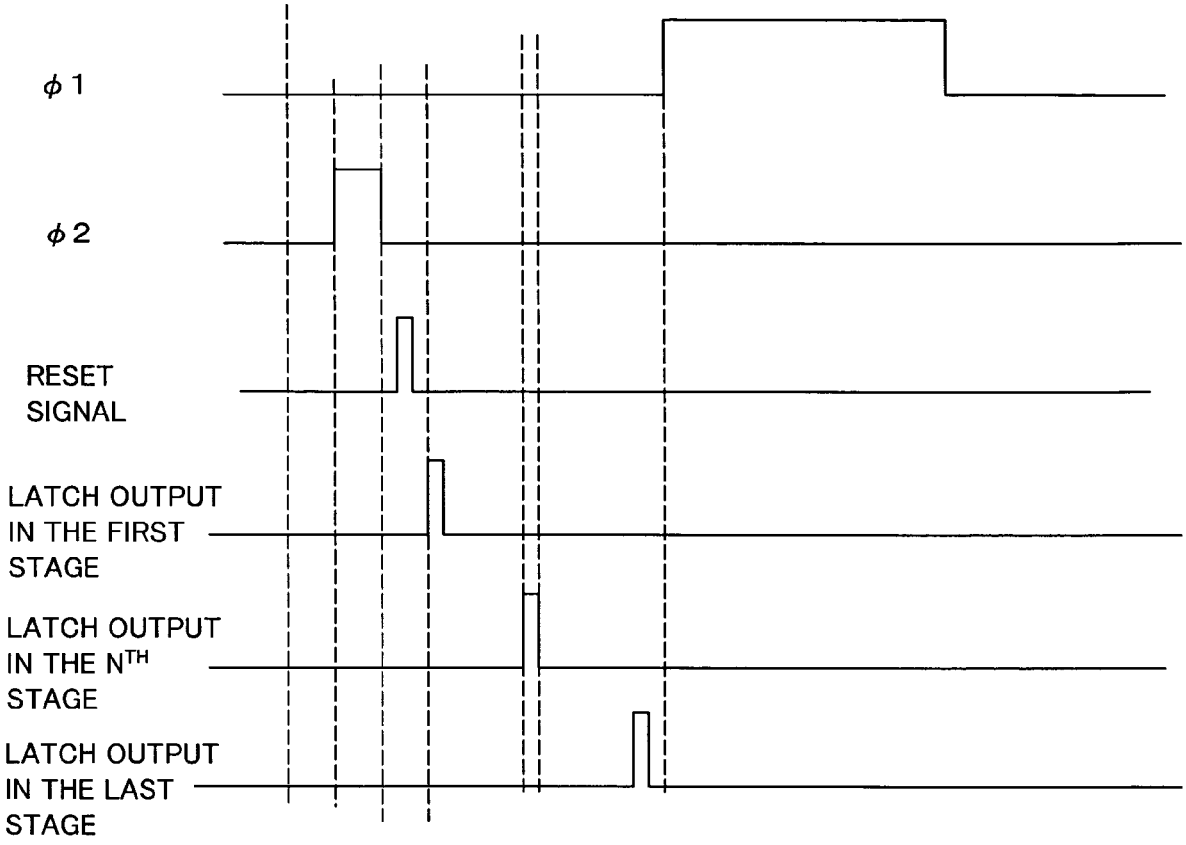
FIG. 11 is a timing chart for describing operation of a current generating circuit.

Operation of the current generating circuit 52 of such a configuration will be described with reference to FIG. 11. In the beginning of one horizontal period (1H), the signal $\phi 2$ is rendered high, turning on the TFT 82, whereby the reference voltage is supplied to one end of the capacitor 78.

The high signal $\phi 2$ also turns on the TFT 76, creating a short circuit between the drain and gate of the TFT 70. As a result, the TFT 70 functions as a diode, and the gate-source voltage is set at the threshold voltage of the TFT 70. Consequently, the difference between the reference voltage and the threshold voltage is held in the capacitor 78.

The signal $\phi 2$ is rendered low, turning off the TFTs 76 and 82 while the reset signal attains the H level and the power source voltage is added to one end of the capacitor 78, increasing the gate voltage of the TFT 70. As a result, the power source voltage is added to the gate voltage Vn of the TFT 70. Although the change of the gate voltage Vn of the TFT 70 is not exactly the power source voltage itself because the charge level of the capacitor 74 is varied, this will cause no problems because the variation can be reduced by capacitance setting of the capacitors 74 and 78, and because the change of the gate voltage is amplified by the TFT 70.

The horizontal scanner sequentially supplies a high control signal to the latch 54 in each column in synchronism with the timing of the video signal on the digital video line, so that the digital video data is taken in the latch 54.

After the digital video signal is completely written for one line, operation based on the AND of the signal of the corresponding bit of the latch 54 and the signal $\phi 1$ is performed. More specifically, when data in the latch 54 is 1, the signal supplied to the gate of the TFT 72 attains the H level for a predetermined period, turning on the TFT 72 and supplying the current in accordance with the gate voltage Vn to the TFT 70 and the data line DL. When the data stored in the latch 54 is 0, the output of the AND gate 84 is fixed to L, and no current is supplied from the current generating circuit 52.

As described above, according to the current generating circuit 52 of the present embodiment, the threshold voltage of the TFT 70 is set at the gate thereof in the beginning of one horizontal period 1H. The TFT 70 is driven by adding the power source voltage to the thus set threshold voltage. As a result, even when the threshold voltage of the TFT 70 in each stage (column) is varied, the variation will not affect the amount of current supplied to the data line DL.

The TFT 82 need not be provided if the reference voltage and the power source voltage are supplied at the predetermined timing through the TFT 80. Further, the AND gate 84 may be omitted by supplying the digital video signal through the TFT 80, and the signal $\phi 1$ may be supplied to the gate of the TFT 72. The gate voltage setting of the TFT 70 can be more ensured by a configuration where initial current is supplied to the TFT 70 from a constant current source or a constant voltage source when the TFT 76 is turned on. While n-channel TFTs are used in the above description, another configuration can be easily achieved with all p-channel TFTs by changing, for example, the polarity of signals.

Figure 12:
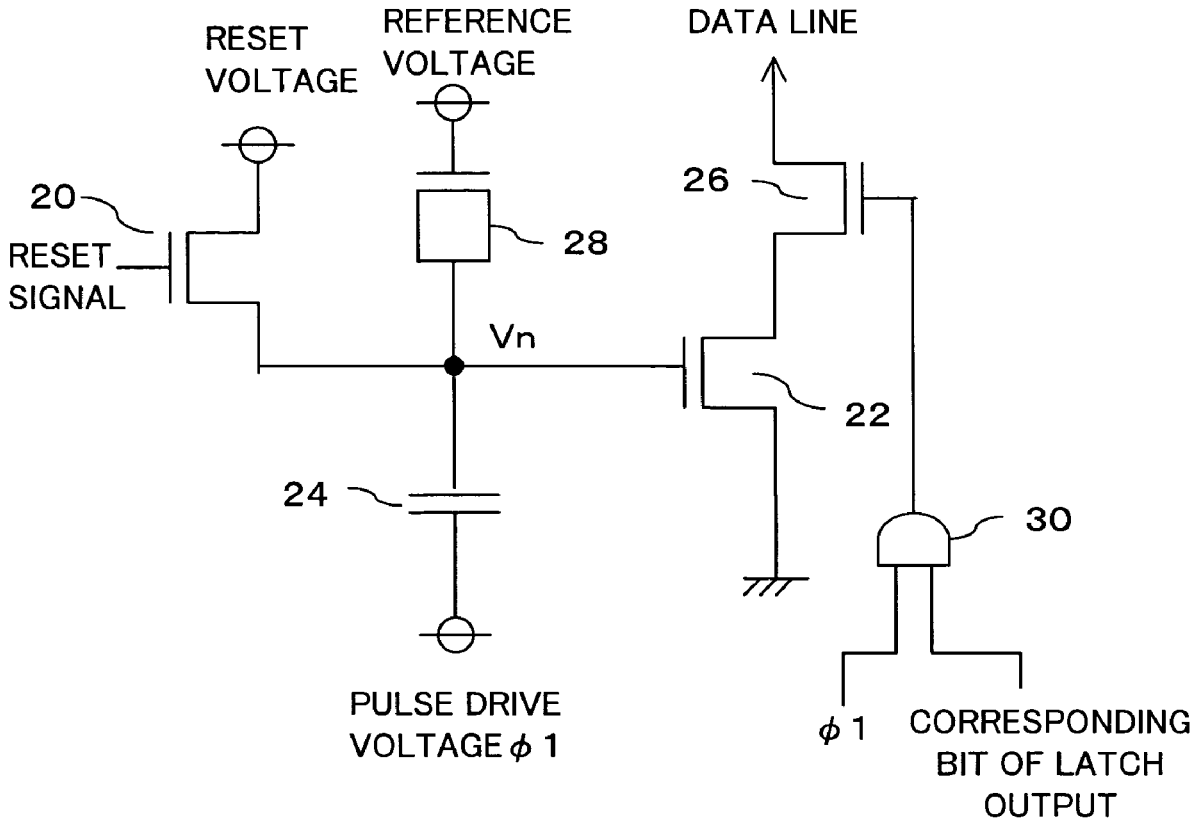
FIG. 12 shows another exemplary configuration of a current generating circuit.

FIG. 12 shows another exemplary configuration of the current generating circuit 52. The configuration in FIG. 12 corresponds to that shown in FIG. 4.

The reset voltage is supplied to the drain of the n-channel TFT 20 whose gate receives the reset signal and source is connected to the gate of the n-channel output TFT 22. The gate of the output TFT 22 to which the source of the TFT 20 is connected is connected to one end of the capacitor 24, whose other end is connected to the pulse drive voltage ϕ1.

The output TFT 22 has a source connected to the ground, and a drain connected to the data line DL through the n-channel TFT 26.

The gate of the output TFT 22 is connected to one end of the n-channel MOS capacitor element 28 whose gate end is connected to a predetermined reference voltage. Here, it should be noted that the MOS capacitor element 28 having source, channel, and drain regions similarly to ordinary TFTs is used simply as a gate capacitor by connecting one of the source and drain electrodes and the gate electrode to predetermined portions.

The MOS capacitor element 28 may have a channel region and an impurity region electrode, which together with the gate electrode are connected to predetermined portions. Examples of the MOS capacitor element 28 include an MOS transistor, an MIS transistor, and a TFT type.

Figure 13:
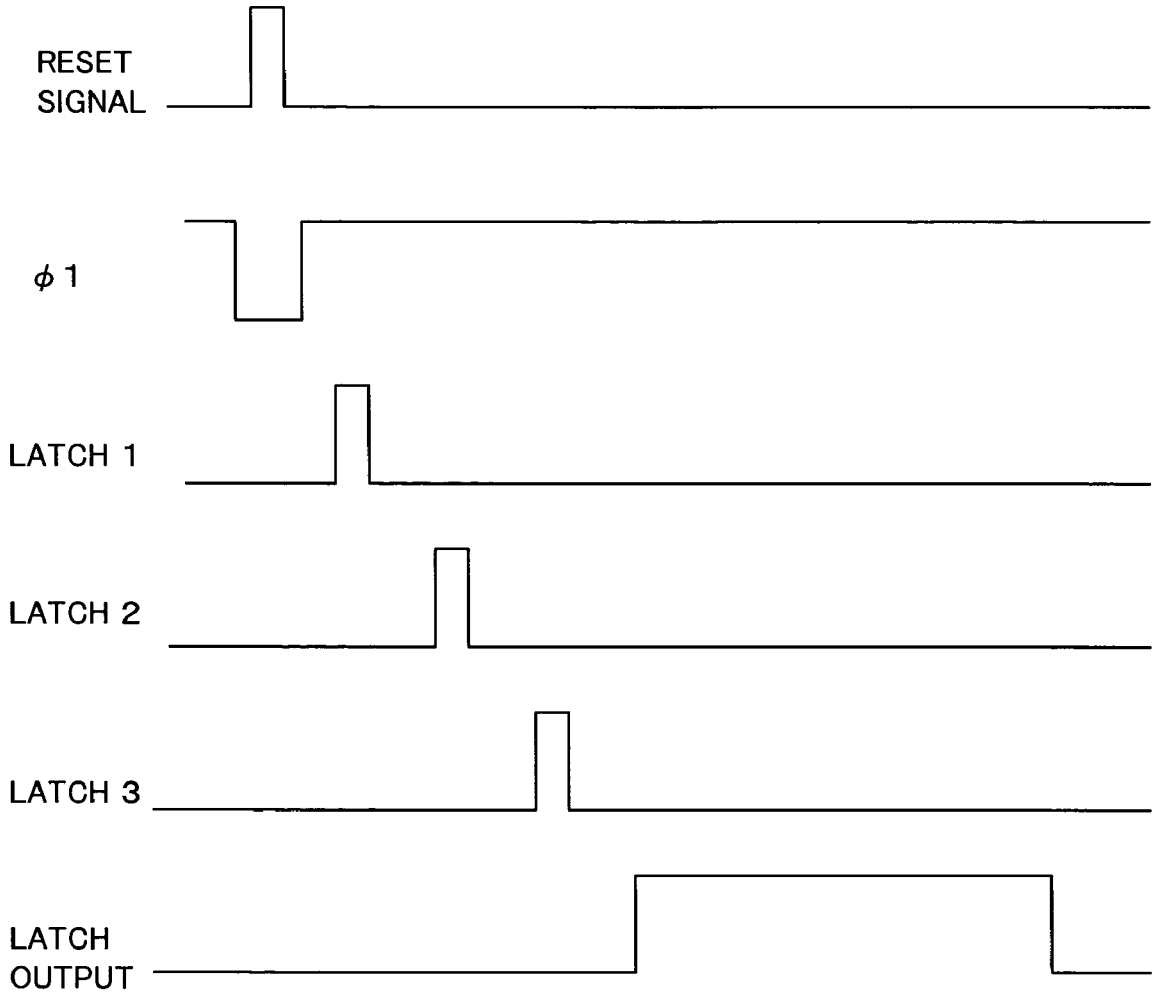
FIG. 13 is a timing chart for describing operation of a current generating circuit 52.

Operation of a current generating circuit 52 configured as described above will next be described with reference to FIG. 13. The signal ϕ1 is rendered L with a predetermined pulse width, while the reset signal attains the H level. As a result of the turning on of the TFT 20 caused by the reset signal rendered H, the reset voltage is set at the gate of the TFT 22. The reset voltage is set at a voltage lower than the reference voltage supplied to the gate of the MOS capacitor element 28 by more than the threshold voltage Vth of the MOS capacitor element 28, and in this state the MOS capacitor element 28 is ON. When the signal ϕ1 is rendered H, the gate voltage of the TFT 22 is set at the below-described voltage obtained by correcting the threshold voltage, and maintained in the storage capacitor 24.

As a result, the output TFT 22 operates in accordance with the voltage maintained in the capacitor 24, and the corresponding current flows through the data line DL.

The video signal from the digital video line is sequentially latched by the latch 54. After data for one horizontal line is latched, the timing signal of the latch output attains the H level, and supplied to an AND gate 30. As a result, the output of the latch 54 is supplied to the TFT 26, which is turned on when data is 1, and the current obtained by compensating for the threshold voltage is supplied from the output TFT 22 to the data line DL.

The current generating circuit 52 in each column outputs data current for one line, and this operation is sequentially repeated.

It should be noted that the output TFT 22 starts the flowing of current when the difference between the power source (ground) and the gate voltage, Vgs, exceeds the threshold voltage Vth determined by the properties of the TFT, and that the amount of current is determined by the difference between the gate voltage and the threshold voltage.

In this example of the current embodiment, the gate of the output TFT 22 is connected to the MOS capacitor element 28 and the other end of the capacitor 24 is connected to the pulse drive voltage ϕ1, thereby compensating for the variation in threshold voltage of the output TFT 22 in each current generating circuit 52.

The MOS capacitor element 28 is formed adjacent to the output TFT 22 at the same manufacturing step as the output TFT 22. Consequently, the output TFT 22 and the MOS capacitor element 28 have substantially the same impurity concentration and the threshold voltage. The pulse drive voltage ϕ1 to which the other end of the capacitor 24 is connected is set so that the channel region of the MOS capacitor element 28 is changed from the ON state to the OFF state when the pulse drive voltage is changed from L to H. Although the pulse drive voltage ϕ1 at the other end of the capacitor 24 is changed after writing of the reset voltage is finished in order to change the channel region of the MOS capacitor element 28 from the ON state to the OFF state in this example, the reference voltage may be changed from H to L while maintaining the voltage ϕ1 as a fixed voltage, or the pulse drive voltage ϕ1 and the reference voltage may be simultaneously changed from L to H and H to L, respectively. In this case, similar effects can be enjoyed by adjusting the pulse width and the element size.

What is claimed is:

1. A display device for presenting display using a current video signal, comprising:

a voltage-current conversion circuit for converting a voltage video signal into a current video signal; and a current driving pixel circuit for receiving the current video signal output from said voltage-current conversion circuit to present display, wherein said voltage-current conversion circuit comprises:

an output transistor for receiving the voltage video signal at a gate, and supplying corresponding drain current, and a compensation circuit for compensating for variation in threshold voltage of said output transistor;

said current driving pixel circuit comprises:

a transistor with a gate connected to a gate line; and a driving transistor that is driven by a current video signal; and the drain current is supplied to the current driving pixel circuit through the transistor with a gate connected to a gate line wherein said compensation circuit comprises:

a storage capacitor for receiving at one end and holding a data voltage supplied to the gate of said output transistor, a first control signal line connected to the other end of said storage capacitor, and receiving a predetermined voltage or a pulsed signal, and a MOS capacitor element having one end connected to the gate of said output transistor, and the other end connected to a second control signal line for receiving a predetermined voltage or a pulsed signal, wherein a capacitance of the MOS capacitor element is changed by varying the ON/OFF state of said MOS capacitor element with a change in voltage on said first or second control signal line.

2. The display device according to claim 1, wherein said voltage video signal is an analog signal whose voltage indicates luminance tone.

3. The display device according to claim 2, wherein said pixel circuit is arranged in a matrix, and said output transistor and said compensation circuit are provided corresponding to each column of said pixel circuit arranged in a matrix, and the circuits are integrated on a single substrate.

4. A display device for presenting display using a current video signal, comprising:

a voltage-current conversion circuit for converting a voltage video signal into a current video signal; and a current driving pixel circuit for receiving the current video signal output from said voltage-current conversion circuit to present display, wherein said voltage video signal is digital data including plural bits, said voltage-current conversion circuit comprises:

a plurality of output transistors for respectively receiving one of said plural bit digital data at a gate, and supplying corresponding drain current, and a plurality of compensation circuits for respectively compensating for variation in threshold voltage of said plurality of output transistors, and said voltage-current conversion circuit supplies to said current driving pixel circuit the current video signal of the summed amount of output current generated by said plurality of output transistors;

said current driving pixel circuit comprises:

a transistor with a gate connected to a gate line; and a driving transistor which that is driven by a current video signal; and the drain current is supplied to the current driving pixel circuit through the transistor with a gate connected to a gate line wherein said plurality of compensation circuits comprises:

a storage capacitor for receiving at one end and holding a data voltage supplied to the gate of said output transistor, a first control signal line connected to the other end of said storage capacitor, and receiving a predetermined voltage or a pulsed signal, and a MOS capacitor element having one end connected to the gate of said output transistor, and the other end connected to a second control signal line for receiving a predetermined voltage or a pulsed signal, wherein a capacitance of the MOS capacitor element is changed by varying ON/OFF state of said MOS capacitor element with a change in voltage on said first or second control signal line.

5. The display device according to claim 4, wherein said voltage-current conversion circuit further includes a storage unit for storing said digital data provided thereto and including plural bits of 0,1 on a bit-by-bit basis, and the digital data indicating 0,1 for each bit and stored in said storage unit is supplied to the gate of the corresponding output transistor.

6. The display device according to claim 5, wherein said pixel circuit is arranged in a matrix, and said output transistor and said compensation circuit are provided corresponding to each column of said pixel circuit arranged in a matrix, and the circuits are integrated on a single substrate.

* * * * *